US010626659B2

(12) United States Patent
Herrmann et al.

(10) Patent No.: US 10,626,659 B2
(45) **Date of Patent: *Apr. 21, 2020**

(54) ASSEMBLY FOR ADJUSTING AN ADJUSTMENT ELEMENT RELATIVE TO A STATIONARY PORTION OF A VEHICLE

(71) Applicant: Brose Fahrzeugteile GmbH & Co. Kommanditgesellschaft, Bamberg, Bamberg (DE)

(72) Inventors: Christian Herrmann, Coburg (DE); Wolfgang Uebel, Weitramsdorf (DE)

(73) Assignees: BROSE FAHRZEUGTELLE GMBH & CO., Bamberg (DE); KOMMANDITGESELLSCHAFT. BAMBERG, Bamberg (DE)

( * ) Notice: Subject to any disclaimer, the term of this patent is extended or adjusted under 35 U.S.C. 154(b) by 257 days.

This patent is subject to a terminal disclaimer.

(21) Appl. No.: 15/459,942

(22) Filed: Mar. 15, 2017

(65) Prior Publication Data

US 2017/0335617 A1 Nov. 23, 2017

(30) Foreign Application Priority Data

May 17, 2016 (DE) ..... 10 2016 208 437

(51) Int. Cl.
*E06B 11/00* (2006.01)
*E05F 15/603* (2015.01)
(Continued)

(52) U.S. Cl.
CPC ..... *E05F 15/603* (2015.01); *E05F 15/616* (2015.01); *E05F 15/619* (2015.01); *E05F 15/622* (2015.01); *E05Y 2900/531* (2013.01)

(58) Field of Classification Search
CPC ..... E05F 15/603; E05F 15/616; E05F 15/622; E05F 15/619; E05Y 2990/531
(Continued)

(56) References Cited

U.S. PATENT DOCUMENTS 5,434,487 A 7/1995 Long et al.
5,582,279 A 12/1996 Buchanan, Jr. et al.
(Continued)

FOREIGN PATENT DOCUMENTS

CN 102216550 A 10/2011
CN 102470735 A 5/2012
(Continued)

OTHER PUBLICATIONS

Notice of Allowance issued in U.S. Appl. No. 15/436,493 dated Mar. 13, 2018.
(Continued)

*Primary Examiner* — Jerry E Redman
(74) *Attorney, Agent, or Firm* — Lewis Roca Rothgerber Christie LLP

(57) ABSTRACT

An assembly for adjusting an adjustment element relative to a stationary portion of a vehicle, in particular a vehicle door relative to a vehicle body, comprises a drive motor for electromotively adjusting the adjustment element and a transmission element. In a coupling, first condition an electrically actuatable coupling device couples the drive motor with the transmission element, in order to exert an adjustment force for adjusting the adjustment element on the transmission element, and in a decoupling, second condition decouples the drive motor from the transmission element. An electrically actuatable locking device serves for locking the adjustment element with the stationary portion of the vehicle in a closed position. A control device controls the drive motor, the coupling device and the locking device.

12 Claims, 3 Drawing Sheets

(51) Int. Cl.
*E05F 15/616* (2015.01)
*E05F 15/619* (2015.01)
*E05F 15/622* (2015.01)

(58) Field of Classification Search
USPC ..... 49/339, 340, 347, 332, 327, 325
See application file for complete search history.

(56) References Cited

U.S. PATENT DOCUMENTS

| | | | | |
|---|---|---|---|---|
| 5,708,338 | A | 1/1998 | Cook et al. | |
| 5,982,126 | A | 11/1999 | Hellinga et al. | |
| 8,474,886 | B2 | 7/2013 | Bendel | |
| 9,234,378 | B2 | 1/2016 | Hansen | |
| 9,388,623 | B2 | 7/2016 | Ette et al. | |
| 9,476,243 | B2 | 10/2016 | Wuerstlein et al. | |
| 9,546,850 | B2 | 1/2017 | Boretto | |
| 9,845,631 | B2 | 12/2017 | Eggeling et al. | |
| 9,868,340 | B2 | 1/2018 | Nishikibe et al. | |
| 2001/0035725 | A1 | 11/2001 | Mintgen et al. | |
| 2005/0155289 | A1* | 7/2005 | Oberheide | E05F 1/1091 49/340 |
| 2012/0245800 | A1 | 9/2012 | Koberstaedt et al. | |
| 2013/0067817 | A1* | 3/2013 | Sorensen | E05F 15/00 49/30 |
| 2014/0188349 | A1 | 7/2014 | Hellmich et al. | |
| 2015/0176322 | A1 | 6/2015 | Wuerstlein et al. | |
| 2017/0335615 | A1* | 11/2017 | Herrmann | E05F 15/40 |
| 2018/0209194 | A1* | 7/2018 | Rietdijk | E05F 15/627 |
| 2018/0216384 | A1* | 8/2018 | Rietdijk | E05F 3/16 |
| 2018/0216392 | A1* | 8/2018 | Rietdijk | E05F 15/627 |
| 2018/0291666 | A1* | 10/2018 | Linden | E05F 15/611 |
| 2019/0128041 | A1* | 5/2019 | Haberberger | E05F 15/41 |

FOREIGN PATENT DOCUMENTS

| | | |
|---|---|---|
| CN | 103597157 A | 2/2014 |
| CN | 104583519 A | 4/2015 |
| CN | 104727691 A | 6/2015 |
| CN | 104903160 A | 9/2015 |
| DE | 694 02 243 T 2 | 7/1997 |
| DE | 696 23 807 T 2 | 1/2003 |
| DE | 696 27 960 T2 | 8/2004 |
| DE | 196 49 698 B4 | 1/2009 |

OTHER PUBLICATIONS

First Chinese Office action dated Jul. 10, 2018 issued in corresponding Chinese Application No. 201710171068.X, 5 pages.
Chinese First Office dated Sep. 6, 2018 cited in corresponding Chinese Application No. 201710229822.0, 5 pages.

* cited by examiner

ASSEMBLY FOR ADJUSTING AN ADJUSTMENT ELEMENT RELATIVE TO A STATIONARY PORTION OF A VEHICLE

REFERENCE TO RELATED APPLICATION

This application claims priority to German Patent Application No. 10 2016 208 437.2 filed on May 17, 2016, the entirety of which is incorporated by reference herein.

BACKGROUND

The invention relates to an assembly for adjusting an adjustment element relative to a stationary portion of a vehicle and to a method for adjusting an adjustment element relative to a stationary portion of a vehicle.

Such adjustment element for example can be realized by a vehicle door, for example a vehicle side door or a tailgate of a vehicle. Such vehicle door can be moved relative to a vehicle body, in order to clear a vehicle opening. The vehicle door for example can be pivotally arranged on the vehicle body. It likewise is conceivable and possible, however, that the vehicle door is shiftably arranged on the vehicle body.

Such assembly comprises a drive motor for electromotively adjusting the adjustment element. An electrically actuatable coupling device is provided, in order to couple the drive motor with a transmission element in a coupling, first condition, in order to exert an adjustment force for adjusting the adjustment element on the transmission element. In a decoupling, second condition of the coupling device the drive motor is decoupled from the transmission element, so that the drive motor at idle can be driven independent of the transmission element or the transmission element can be moved independent of the drive motor for example for manually adjusting the adjustment element.

In a closed position the adjustment element for example closes a vehicle opening. In this closed position the adjustment element is locked with the stationary portion of the vehicle, for example the vehicle body, by means of a locking device (e.g. in the form of a door lock), so that in the closed position the adjustment element is blocked relative to the stationary portion and in particular cannot be moved out of the closed position without unlocking the locking device. In an unlocked condition the locking device releases the adjustment element, so that the adjustment element can be moved out of the closed position, for example in order to open a vehicle door.

The locking device for example includes a rotary latch (on the adjustment element or the stationary portion), which in the locked condition is in engagement with a striker (on the stationary portion or the adjustment element) and thereby locks the adjustment element with the stationary portion. The rotary latch can be unlocked, in order to provide for adjusting the adjustment element relative to the stationary portion.

A control device is provided, in order to control the drive motor, the coupling device and the locking device.

The assembly thus serves for electromotively adjusting the adjustment element, for example a vehicle door of a vehicle. In its closed position a vehicle door usually rests against the vehicle body via a seal and is held at the seal with pressure via the locking device (for example in the form of a door lock), so that the seal provides a suitable sealing effect between the vehicle door and the vehicle body for moisture-tight sealing of the vehicle opening and at the same time produces an elastic pretension between the vehicle door and the vehicle body.

When a locking device in the form of a door lock conventionally is unlocked for opening a vehicle door, the pretension provided via the seal leads to the fact that after unlocking of the locking device the vehicle door springs out a little from its closed position, before the vehicle door is moved on with preferably constant speed by means of the drive motor and is brought into an open position. Thus, the opening operation initially is non-uniform and uncontrolled, which can be perceived as disturbing.

SUMMARY

It is an object of the present invention to provide an assembly and a method for adjusting an adjustment element relative to a stationary portion of a vehicle, which provide for a uniform, controlled adjustment of the adjustment element out of its closed position.

This object is solved by a subject-matter with features as described herein.

For adjusting the adjustment element out of the closed position, the control device accordingly is formed to

- initially actuate the coupling device for transferring from the decoupling, second condition into the coupling, first condition and the drive motor for exerting an adjustment force on the transmission element, and
- subsequently transfer the locking device from the locked condition into the unlocked condition.

Before unlocking the adjustment element, for example the vehicle door, it accordingly is provided to couple the drive motor via the coupling device and let it start, in order to thereby pretension the adjustment mechanism, before the locking device is unlocked. Because before unlocking of the locking device the coupling device thus is brought into the coupling, first condition and the drive motor is actuated to exert an adjustment force on the transmission element, the adjusting operation of the adjustment element, for example the vehicle door, can start in a controlled way directly after unlocking of the locking device, so that after unlocking of the locking device uncontrolled springing out of the closed position by the adjustment element can be avoided, because the adjustment element already is in the flux of force via the coupling device and the drive motor when the locking device is unlocked, and thus is held in position in a controlled way via the drive motor and the coupling device.

Due to the temporally staggered actuation of the coupling device and the drive motor on the one hand and of the locking device on the other hand it can thus be achieved that the adjustment of the adjustment element out of its closed position is effected in a controlled way along the entire adjustment path. In this way, the adjusting movement can be rendered more uniform, which also allows to achieve a faster adjusting operation for transferring the adjustment element from the closed position into an open position, because the adjustment of the adjustment element swiftly can start after unlocking and in particular no more system slack must be compensated after unlocking.

In an advantageous aspect the control device is formed to actuate the drive motor for adjusting the adjustment element in an opening direction out of the closed position, before the locking device is unlocked. Thus, before unlocking of the locking device the drive motor already is driven in direction of opening of the adjustment element, so that after unlocking the opening movement of the adjustment element can start directly in a controlled way.

Actuating the drive motor and unlocking the locking device can be adjusted to each other in a controlled way. For example it can be provided that the control device actuates the locking device for transferring from the locked condition into the unlocked condition after a predetermined time, after the drive motor has been actuated to exert an adjustment force. It also is conceivable and possible that the locking device is unlocked when the drive motor has effected a predetermined adjustment path of the transmission element. For example it can be provided for this purpose that the drive motor is driven for driving a predetermined number of revolutions of a drive shaft of the drive motor (which corresponds to a predetermined adjustment path of the transmission element or the compensation of a predetermined system slack in the system), before the locking device is unlocked. It also is conceivable and possible to effect unlocking of the locking device in a force-controlled way, for example when it is detected e.g. by means of the motor current that a predetermined adjustment force is applied or exceeded at the drive motor.

The control device is formed to automatically adjust the adjustment element out of the closed position in an electromotively controlled way. For this purpose the control device actuates the drive motor, the coupling device and the locking device, wherein the actuation is effected in a temporally coordinated way, as described above. An opening operation for example can be initiated by a user who for example actuates a suitable actuating device, which can be part of the vehicle or which also can be formed as actuating device in the manner of a remote control (radio key), which thereupon generates an opening signal for opening the adjustment element and outputs the same to the control device which then initiates the opening operation.

The control device for example can be part of the assembly of the adjustment element, for example of the vehicle door. However, it also is conceivable and possible that the control device is formed by a central control device of the vehicle.

Independent of an opening operation the control device also can be formed, according to a further aspect, to actuate the drive motor for executing a diagnostic routine, while the locking device is in the locked condition.

This proceeds from the idea that with locked adjustment element, for example with locked vehicle door, it is possible to check whether the system is in a condition ready for operation or malfunctions possibly exist. In dependence on a diagnostic routine it is possible to newly calibrate the system, if necessary, to newly adjust system parameters or to indicate possible errors, so that maintenance is possible.

In a condition in which the driving device thus is not needed to adjust the adjustment element (namely with locked, closed adjustment element), it thus is possible to perform tests by means of which the operability of the adjustment system can be checked. In this way, for example ageing phenomena in the adjustment system, for example ageing phenomena at the drive motor or at the coupling device, can be detected, so that a (re)calibration can be effected or error messages can be generated, in order to indicate malfunctions.

In principle, such diagnostic routines can take place while the coupling device is in the coupling, first condition or in the decoupling, second condition. Depending on the condition of the coupling device different diagnostic routines can be carried out, in order to check different functions of the adjustment system.

For example, the control device can be formed to drive the drive motor for executing a first diagnostic routine, while the coupling device is in the decoupling, second condition. For example, with decoupled coupling device the drive motor can be actuated with a predetermined motor voltage, and by measuring the rotational speed of a motor shaft of the drive motor it can be checked whether there is obtained a rotational speed which should be obtained at the predetermined motor voltage. This can be repeated for different motor voltages, so that characteristic curves can be recorded, by means of which the functionality of the drive motor can be verified.

The rotational speed of the motor shaft for example can be measured via a suitable sensor, for example a Hall sensor.

In addition, the idling current can be determined by driving the motor with decoupled coupling device.

The control device also can be formed to drive the drive motor for executing a second diagnostic routine, while the coupling device is in the coupling, first condition. This second diagnostic routine thus is executed while the drive motor via the coupling device is coupled with the transmission element, via which adjustment forces for adjusting the adjustment element are transmitted. By means of this second diagnostic routine for example a system slack can be determined, i.e. a play in the system, for example due to an elasticity of the components in the power transmission train, and the operability of the coupling device can be checked.

To determine the system slack or elasticity of the system, the drive motor for example initially can be driven in a direction corresponding to the opening direction, until it is detected that the motor blocks by means of a detection of the motor current, because a system slack is compensated or elasticity is overcome (so-called block detection). By subsequently driving the drive motor in the opposite direction of rotation (which corresponds to a closing direction) it can in turn be detected by means of a detection of the motor current when the motor blocks in the opposite direction, because the system slack is compensated or the elasticity is overcome in the opposite direction. By such block-to-block detection the system slack or elasticity on the whole can be measured.

By driving the motor when the coupling is closed, up to blocking of the drive motor (block detection), it can also be checked whether the coupling device possibly slips through and at which driving force such slipping through occurs. It thus is possible to check the operability of the coupling device and its function for the power transmission from the drive motor to the transmission element. By means of such determination of the slip point of the coupling device the actuation of the coupling device, for example for shifting the slip point, then can be adapted and thus a parameter adaptation for adapting the coupling device can be performed.

By actuating the drive motor when the locking device is locked and the coupling device is coupled, it also is possible to draw conclusions as to the elasticity in the entire system, for example in the vehicle door.

In a development the coupling device can have a slipping, third condition, in which a first coupling element operatively connected with the drive motor and a second coupling element operatively connected with the transmission element slippingly cooperate. In this slipping, third condition of the coupling device the drive motor thus is coupled with the transmission element to a limited extent, wherein in this condition a braking force for example can be provided via the coupling device, in order to brake a manual adjustment of the adjustment element independent of the drive motor in a controlled way. For such braking effect the first coupling element for example can be retained via the drive motor, while the second coupling element, which is operatively connected with the transmission element, is moved when the transmission element is moved relative to the first coupling element and thereby slips at the first coupling element, so that the first coupling element and the second coupling element slippingly cooperate.

For this slipping, third condition of the coupling device the control device also can be formed to carry out a diagnosis. For example, the control device can be formed to actuate the drive motor for executing a third diagnostic routine, while the coupling device is in the slipping, third condition. In this way, for example, the braking effect of the coupling device can be measured, in order to calibrate the braking effect and to be able to adjust the same in a controlled way in the future operation. For determining the braking force the drive motor can be driven, wherein the motor current is measured, in order to determine the braking force provided by the coupling device in the slipping, third condition with reference to the motor current.

It also is conceivable and possible to effect cleaning of the (braking) coupling device by means of a third diagnostic routine by driving the drive motor in the slipping, third condition of the coupling device, in that the coupling elements of the coupling device are slippingly moved relative to each other.

Diagnostic routines as described above can be carried out in the manufacture or assembly of the adjustment element, e.g. of the vehicle door, hence in the production (e.g. as so-called end-of-line test as operability test after the manufacture). Such diagnostic routines can, however, also be carried out during operation after delivery of the vehicle to a customer. The diagnostic routines can be executed by the control device under completely automatic control, wherein an adaptation of system parameters and a calibration of the system can be performed automatically by the control device and error messages also can be generated and displayed automatically. By using such diagnostic and control routines ageing effects in the entire system of the adjustment element can be compensated and post-normalized, so that the operability of the adjustment system is obtained, possible malfunctions can be compensated or error messages can be generated, in order to provide for maintenance.

The object also is solved by a method for adjusting an adjustment element relative to a stationary portion of a vehicle, in particular a vehicle door relative to a vehicle body. In the method

- a drive motor electromotively adjusts the adjustment element,
- an electrically actuatable coupling device in a coupling condition couples the drive motor with a transmission element, in order to exert an adjustment force for adjusting the adjustment element on the transmission element, and in a decoupled condition decouples the drive motor from the transmission element,
- in a locked condition of the adjustment element an electrically actuatable locking device in a closed position locks with the stationary portion, and in an unlocked condition releases the adjustment element for adjusting the adjustment element relative to the stationary portion, and
- a control device controls the drive motor, the coupling device and the locking device.

It is provided that for adjusting the adjustment element out of the closed position the control device

- initially actuates the coupling device for transferring from the decoupling condition into the coupling condition and the drive motor for exerting an adjustment force on the transmission element, and
- subsequently actuates the locking device for transferring from the locked condition into the unlocked condition.

The advantages and advantageous aspects described above for the assembly analogously also apply to the method, so that reference will be made to the above explanations.

BRIEF DESCRIPTION OF THE DRAWINGS

The idea underlying the invention will be explained in detail below with reference to the exemplary embodiments illustrated in the Figures.

DETAILED DESCRIPTION

Figure 1:
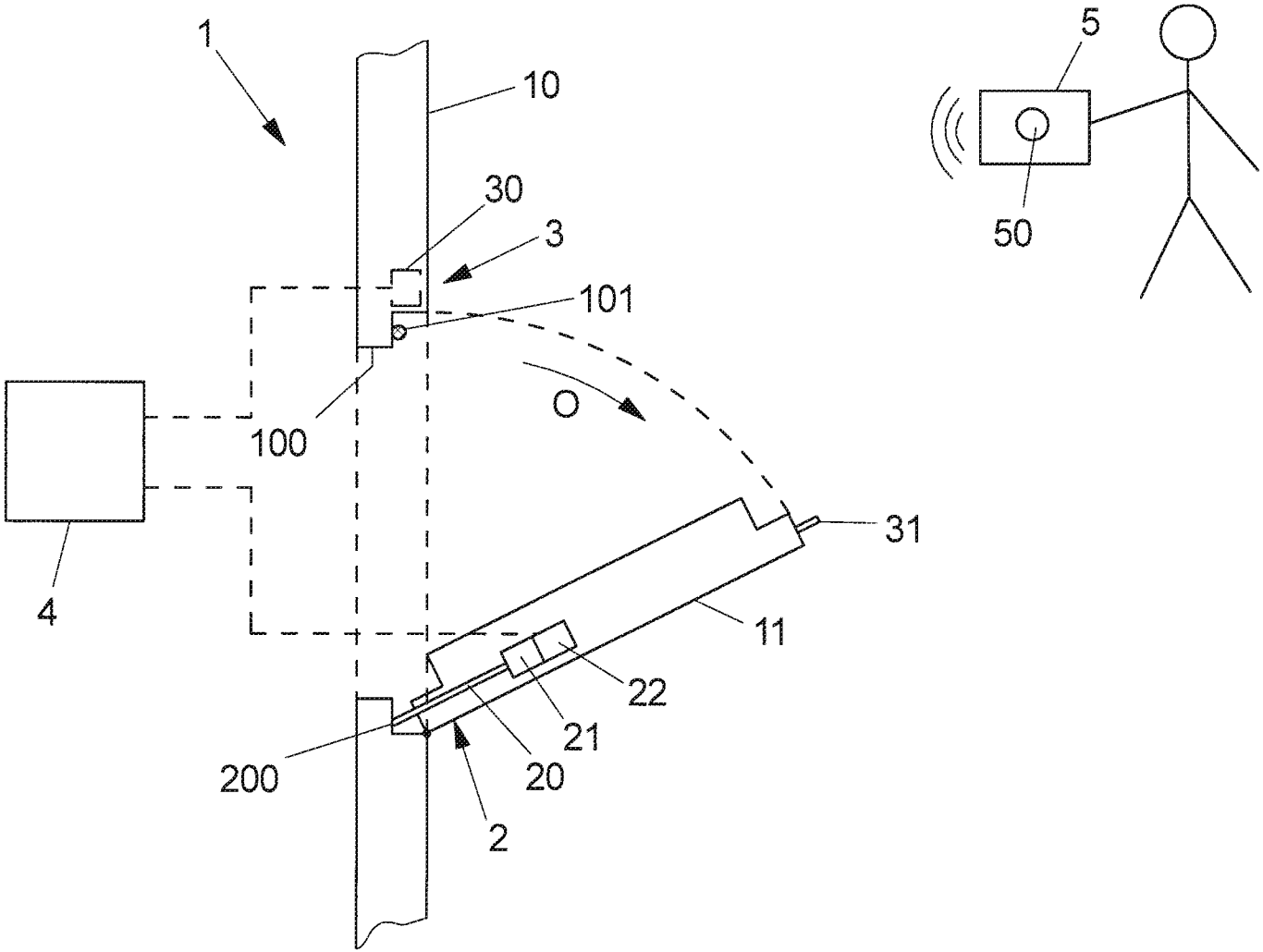
FIG. 1 shows a schematic view of an adjustment element in the form of a vehicle door at a stationary portion in the form of a vehicle body.

FIG. 1 shows a schematic view of a vehicle 1 which includes a vehicle body 10 and an adjustment element in the form of a vehicle door 11, which is pivotable on the vehicle body 10 about a pivot axis along an opening direction O.

The adjustment element 11 can be realized for example by a vehicle side door or also by a tailgate. In a closed position the adjustment element 11 covers a vehicle opening 100 in the vehicle body 10, for example a transverse opening or a tailgate opening in the vehicle body 10.

It should be noted that the adjustment element 11 for example can also be shiftably arranged on the vehicle body 10, for example as sliding door. What will be explained below analogously is also applicable to the adjustment element to be shifted.

By means of a driving device 2 the adjustment element 11 is electromotively movable from its closed position into an open position, so that the adjustment element 11 in the form of the vehicle door can be moved automatically in an electromotive way. The adjusting device 2, schematically illustrated in FIG. 1 and schematically shown in FIG. 2 in an exemplary embodiment, includes a drive motor 22 which via a coupling device 21 is coupled with a transmission element 20 by means of which adjustment forces can be transmitted between the adjustment element 11 and the vehicle body 10. The drive motor 22 for example can be stationarily arranged on the adjustment element 11, while the transmission element 20 for example in the manner of a so-called catch strap is articulated to an end 200 and thus pivotally fixed at the vehicle body 10.

Figure 2:
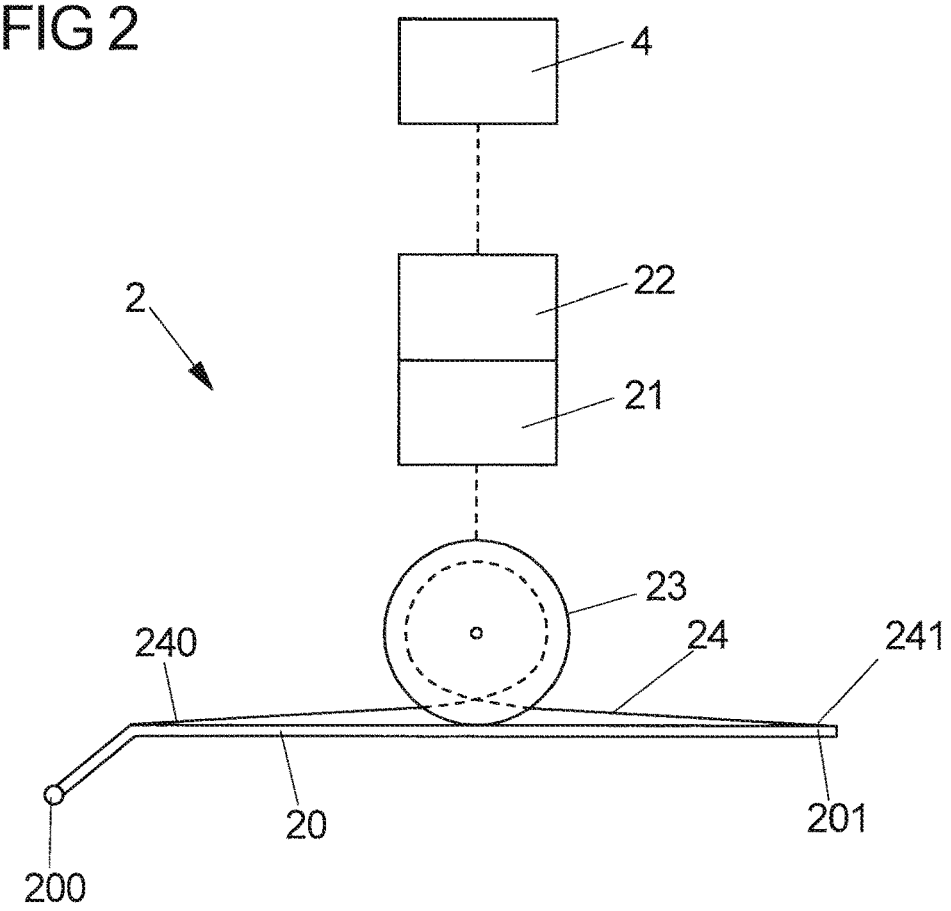
FIG. 2 shows a schematic view of an assembly with a drive motor, a coupling device, a control device and a transmission element for power transmission for adjusting the adjustment element.

In the exemplary embodiment of the driving device 2 as shown in FIG. 2 the drive motor 22 serves for driving a drive element 23 in the form of a cable drum which via a coupling element 24 in the form of a flexible, slack pulling element, in particular in the form of a pull cable (for example a steel cable) formed to transmit (exclusively) tensile forces, is coupled with the transmission element 20. The cable drum 23 for example can be supported on the longitudinally extending transmission element 20 and roll off on the transmission element 20. The coupling element 24 is connected with the transmission element 20 via a first end 240 in the region of the end 200 of the transmission element 20 and via a second end 241 in the region of a second end 201 and slung around the drive element 23 in the form of the cable drum. When the drive element 23, driven by the drive motor 22, is put into a rotary movement, the coupling element 24 in the form of the pulling element (pull cable) rolls off on the drive element 23, so that the drive element 23 is moved relative to the transmission element 20 and thus along the longitudinal direction of the transmission element 20 relative to the transmission element 20, which leads to the adjustment element 11 being adjusted relative to the vehicle body 10.

It should be noted at this point that other construction forms of driving devices also are conceivable and possible. For example, the drive motor 22 also can drive a pinion which is in meshing engagement with the transmission element 20. It also is conceivable and possible that the driving device is formed as spindle drive for example with a rotatable spindle which is in engagement with a spindle nut.

The coupling device 21 serves to couple the drive motor 22 with the drive element 23 or to decouple the same from the drive element 23. In a coupling condition the coupling device 21 produces a flux of force between the drive motor 22 and the drive element 23, so that a rotary movement of a motor shaft of the drive motor 20 is transmitted to the drive element 23 and accordingly the drive element 23 is put into a rotary movement, in order to thereby introduce an adjustment force into the transmission element 20. In a decoupling condition, on the other hand, the drive motor 22 is decoupled from the drive element 23, so that the drive motor 22 can be moved independent of the drive element 23 and inversely the drive element 23 can be moved independent of the drive motor 22. In this decoupling condition for example a manual adjustment of the adjustment element 11 can be possible without the drive motor 22 being loaded with forces.

Figure 4:
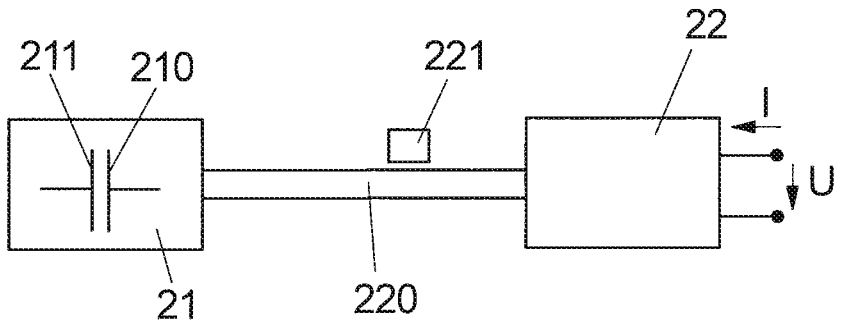
FIG. 4 shows a schematic view of a drive motor and a coupling device.

The coupling device 21 also can have a third coupling condition, corresponding to a slipping condition in which coupling elements 210, 211, schematically shown in FIG. 4, slipplingly are in contact with each other. A first coupling element 210 here is operatively connected with a motor shaft 220 of the drive motor 22, while a second coupling element 211 is operatively connected with the drive element 23. In this slipping, third condition the coupling device 21 for example can provide a braking force during a manual adjustment of the adjustment element 11, caused by the slipping contact of the coupling elements 210, 211 at each other.

In the closed position of the adjustment element 11 a locking element 31 for example in the form of a striker on the part of the adjustment element 11 engages in a lock 30 of a locking device 3 on the part of the vehicle body 10, so that the adjustment element 11—in a manner known per se—locks with the vehicle body 11 and thus is blocked in its closed position. When the adjustment element 11 is to be moved out of the closed position in the opening direction O, the locking device 3 is to be unlocked, in that the lock 30 releases the locking element 31 and thus the adjustment element 11 can be moved out of the closed position.

Figure 3:
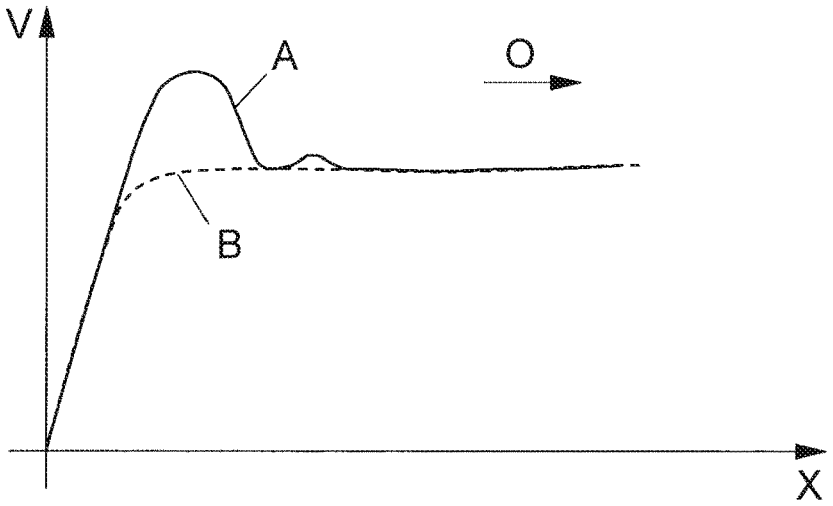
FIG. 3 shows a schematic view of the adjustment speed along the adjustment path on opening of the adjustment element.

In the closed position the adjustment element 11, as shown in FIG. 1, rests against a door seal 101 and in the closed position is held at the seal 101 with pressure, so that a pretensioning force exists between the adjustment element 11 and the vehicle body 10. When the locking device 3 is unlocked with closed adjustment element 11, this pretensioning force conventionally effects initial springing open of the adjustment element 11 out of the closed position, as is graphically illustrated in FIG. 3 along the adjustment path with reference to the course A of the adjustment speed V of the adjustment element 11. It can clearly be seen that at the beginning of the adjusting movement for opening the adjustment element 11 a peak in the adjusting movement initially occurs, whereupon the further adjusting operation driven by the adjusting device 2 is effected with at least approximately constant adjustment speed.

To provide for a uniform adjusting operation and in particular avoid peaks in the adjustment speed, it is proposed here to perform the actuation of the adjusting device 2 and the locking device 3 for opening the adjustment element 11 in a particular, coordinated way.

A control device 4, which serves for controlling the adjusting device 2 and the locking device 3, is formed to initially actuate the adjusting device 2 and only subsequently the locking device 3, when the adjustment element 11 is to be opened out of its closed position.

For example, a user can initiate an opening operation via an actuating unit 5 in the form of a radio key, for example by a user pressing a button 50 of the actuating unit 5, thereby generating an opening signal which is communicated to the control device 4. When the control device 4 detects that the adjustment element 11 is to be opened, the control device 4 initially actuates the coupling device 21 and transfers the coupling device 21 from the decoupling condition into the coupling condition (unless the coupling device 21 anyway already is in the coupling condition). The drive motor 22, actuated by the control device 4, then is energized in the opening direction O. The locking device 3 only subsequently is actuated by the control device 4, in order to transfer the locking device 3 from the locked condition into the unlocked condition and thus release the adjustment element 11 for adjustment out of the closed position.

Due to the fact that the driving device 2 initially is actuated in the opening direction O for adjusting the adjustment element 11 and only subsequently unlocking of the locking device 3 is effected, the drive motor 22 pretensions the system before unlocking and in particular compensates a system slack, so that after unlocking a controlled adjusting operation can directly be initiated, in order to move the adjustment element 11 out of the closed position in a controlled way. Due to the fact that the drive motor 22 already is coupled and driven before unlocking, peaks in the adjustment speed can be compensated and the adjusting movement thus can be rendered more uniform, as is illustrated with reference to the course B in FIG. 3, because the adjusting operation proceeds in a way guided by the drive motor 22 along the entire adjustment path.

The time period between the actuation of the drive motor 22 and unlocking of the locking device 3 can be set with reference to a predetermined time, with reference to a predetermined adjusting movement of the drive motor 22 or for example also in a force-controlled way.

It can be provided for example to actuate the drive motor a predetermined time period before unlocking of the locking device 3, for example 100 ms before unlocking.

It also is conceivable and possible that the drive motor 22 for driving the motor shaft 220 is actuated for a predetermined number of revolutions, for example 2 revolutions, before the locking device 3 is unlocked. The drive motor 22 thus is actuated for a predetermined path length which for example can be set with reference to a system slack.

Alternatively, it also is possible to effect unlocking of the locking device 3 in a force-controlled way. For this purpose for example the motor current can be monitored. When it is detected that the drive motor 22 blocks or the motor current rises above a threshold value, this indicates that a system slack is compensated and adjustment forces thus can directly be transmitted to the adjustment element via the transmission element 20, whereupon unlocking of the locking device 3 can be effected.

The locking device 3 on the part of the lock 30 for example can include a locking mechanism in the manner of a striker which on closing of the adjustment element 11 lockingly gets in engagement with the locking element 31 on the part of the adjustment element 11 and thus accomplishes locking. The lock 30 can be actuated electrically, in order to release the locking element 31 and thus unlock the adjustment element 11, so that the adjustment element 11 can be moved out of the closed position for opening.

In a further aspect it can be provided to form the control device 4 for executing one or more diagnostic routines, in which the operability in particular of the driving device 2 can be checked. The control device 4 therefor is formed to actuate the coupling device 21 and the drive motor 22 with locked locking device 3, in order to execute diagnostic routines for checking different functionalities and system parameters.

In general, the adjustment element 11 is in the closed condition when executing such diagnostic routines and is locked via the locking device 3, which is in the locked condition. In different coupling conditions of the coupling device 21 different diagnostic routines can be executed, in order to check different functions, adapt different parameters and possibly carry out a calibration and post-normalization of the system.

A first diagnostic routine can be executed while the coupling device 21 is in its decoupling condition and the drive motor 22 thus is not coupled with the drive element 23. The coupling device 21 thus is open. In this coupling condition the drive motor 22 for example can be driven by applying for example a predetermined motor voltage U (see FIG. 4) to the drive motor 22, in order to measure the resulting rotational speed of the motor shaft 220 for example by using a sensor 221 in the form of a Hall sensor and/or determine a resulting idling current I.

Another, second diagnostic routine can be executed while the coupling device 21 is in the coupling condition and a flux of force thus is produced between the drive motor 22 and the drive element 23. In connection with this diagnostic routine for example a system slack can be determined, for example by driving the drive motor 22 in an adjustment direction, until blocking of the drive motor 22 is detected, in order to then drive the drive motor 22 in the opposite adjustment direction, until blocking of the drive motor 22 again is detected. The path length between the blocking conditions of the drive motor 22 corresponds to the system slack. Blocking of the drive motor 22 for example can be detected with reference to the motor current I, for example with reference to a rise of the motor current I beyond a predetermined threshold.

Figure 5:
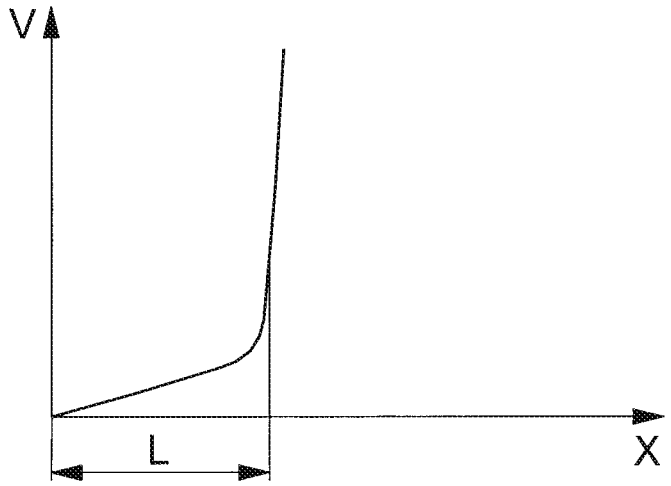
FIG. 5 shows a schematic view of the motor current along the adjustment path in a block detection.

This is illustrated in FIG. 5. For example, by moving the motor in one direction blocking of the drive motor 22 can be determined with reference to a rise of the motor current I, in order to therefrom derive the system slack L in this adjustment direction. The system slack L can be stored as parameter, in order to include the system slack L in the control of the adjusting device 2.

In connection with this diagnostic routine the elasticity of the entire system also can be measured in general. For this purpose, too, the motor current I can be monitored, in order to measure the system elasticity with reference to a rise of the motor current I and its slope.

In connection with this diagnostic routine it can also be determined whether and possibly at which adjustment force the coupling device 21 slips through. When the coupling is released at a certain adjustment force (the so-called slip point of the coupling), this can be stored as parameter, wherein the coupling device 21 can be adapted by suitable control for example for pressing the coupling elements 210, 211 against each other and the pressing force can be set for specifying a desired slip point.

A third diagnostic routine can be carried out while the coupling device 21 is in its slipping condition, i.e. the coupling elements 210, 211 slipplingly rest against each other. In connection with this diagnostic routine for example the braking force provided by the slipping abutment of the coupling elements 210, 211 against each other can be determined. With reference to this diagnosis and parameters derived therefrom for example a braking force can be set as desired in actual operation when the adjustment element 11 is manually adjusted.

In connection with this diagnostic routine it is also conceivable and possible, for example, to clean the coupling device 21 for providing the braking force and to regenerate a brake lining (so-called braking off). For this purpose the drive motor 22 is energized, in order to move the coupling elements 210, 211 relative to each other and slippingly rub the same against each other.

By executing such diagnostic routines—with closed adjustment element 11—the operability of the adjusting device 2 can be checked. In this way, for example ageing effects can be detected and possibly be compensated. For example, parameters of the adjusting device 2 can be post-normalized and adapted, in order to adapt certain functions of the adjusting device 2 and compensate changes in their properties for example due to ageing. It also is conceivable and possible to generate error messages, which for example can be indicated to a maintenance personnel and thus provide for an efficient maintenance.

Such diagnostic routines can be carried out during assembly, i.e. on the part of the manufacturer of a vehicle door, in order to verify the initial operability of the system. Such diagnostic routines can, however, also be carried out repeatedly in operation of the vehicle 1, in order to check the function of the adjusting device 1 at predetermined time intervals.

The idea underlying the invention is not limited to the preceding exemplary embodiments, but can also be realized in principle in a completely different way.

In particular, an adjusting device as described here for adjusting a vehicle side door, a tailgate or another adjustment element can be used in a vehicle. Such adjustment element in principle can be pivotally or also shiftably arranged on the vehicle.

The adjustment system can be designed quite differently and is not limited to the exemplary embodiments described here. For example, a spindle drive or also a rack-and-pinion drive can be used, in order to adjust the adjustment element, wherein completely different embodiments, for example cable drives or the like, can also be used.

LIST OF REFERENCE NUMERALS

1 vehicle
10 stationary portion (vehicle body)
100 vehicle opening
101 seal
11 adjustment element (vehicle door)
2 driving device

20 transmission element (catch strap)
200, 201 end
21 coupling device
210, 211 coupling elements
22 drive motor
220 motor shaft
221 speed sensor (Hall sensor)
23 drive element
24 coupling element (pull cable)
240, 241 end
3 locking device
30 lock
31 locking element
4 control device
5 actuating unit
50 control knob
A, B course
I motor current
L system slack
O opening direction
U motor voltage
x path

The invention claimed is:

1. An assembly for adjusting an adjustment element relative to a stationary portion of a vehicle, in particular a vehicle door relative to a vehicle body, the assembly comprising:

a drive motor for electromotively adjusting the adjustment element;

a transmission element;

an electrically actuatable coupling device which, in a coupling first condition, couples the drive motor with the transmission element in order to exert an adjustment force for adjusting the adjustment element on the transmission element, and in a decoupling second condition decouples the drive motor from the transmission element;

an electrically actuatable locking device for locking the adjustment element with the stationary portion of the vehicle in a closed position, wherein the locking device has a locked condition in which the locking device is locked relative to the stationary portion for locking the adjustment element in the closed position, and an unlocked condition in which the locking device is unlocked for adjusting the adjustment element relative to the stationary portion; and a control device for controlling the drive motor, the coupling device, and the locking device, wherein for adjusting the adjustment element out of the closed position the control device is formed to:

initially actuate the coupling device for transferring from the decoupling second condition into the coupling first condition and the drive motor for exerting an adjustment force on the transmission element; and subsequently transfer the locking device from the locked condition into the unlocked condition.

2. The assembly according to claim 1, wherein the control device is formed to actuate the drive motor for adjusting the adjustment element in an opening direction out of the closed position.

3. The assembly according to claim 1, wherein the control device is formed to actuate the drive motor for a predetermined time, for a predetermined adjustment path of the transmission element, or until a predetermined adjustment force is reached, before the locking device is transferred from the locked condition into the unlocked condition.

4. The assembly according to claim 1, wherein the control device is formed to initiate an adjusting operation for adjusting the adjustment element out of the closed position, when the control device is configured to receive an opening signal for opening the adjustment element.

5. The assembly according to claim 1, wherein the control device is formed to actuate the drive motor for executing a diagnostic routine while the locking device is in the locked condition.

6. The assembly according to claim 5, wherein, for executing a first diagnostic routine, the drive motor is driven while the coupling device is in the decoupling second condition.

7. The assembly according to claim 6, wherein the drive motor is actuated with a predetermined motor voltage and wherein a resulting rotational speed of the drive motor is measured.

8. The assembly according to claim 5, wherein, for executing a second diagnostic routine, the drive motor is driven while the coupling device is in the coupling first condition.

9. The assembly according to claim 8, wherein the drive motor is driven and a motor current is configured to be measured in order to detect a system slack in a system including the drive motor, the coupling device, and the transmission element with reference to a rise of the motor current.

10. The assembly according to claim 5, wherein the coupling device has a slipping third condition in which a first coupling element operatively connected with the drive motor and a second coupling element operatively connected with the transmission element slippingly cooperate, wherein for executing a third diagnostic routine the drive motor is driven while the coupling device is in the slipping third condition.

11. The assembly according to claim 10, wherein the drive motor is driven and wherein a motor current is measured in order to determine a braking force provided by the coupling device in the slipping third condition with reference to the motor current.

12. A method for adjusting an adjustment element relative to a stationary portion of a vehicle, in particular a vehicle door relative to a vehicle body, the method comprising:

electromotively adjusting the adjustment element using a drive motor;

an electrically actuatable coupling device which, in a coupling condition, is configured to couple the drive motor with a transmission element, in order to exert an adjustment force for adjusting to adjustment element on the transmission element, and which, in a decoupling, is configured to decouple the drive motor from the transmission element;

providing an electrically actuatable locking device which, in a locked condition, is configured to lock the adjustment elrment with the stationary portion in a closed position, and which, in an unlocked condition, is configured to release the adjustment element for adjusting the adjustment element relative to the stationary portion; and controlling, via a control device, the drive motor, the coupling device, and the locking device;

wherein, for adjusting the adjustment element out of the closed position, the control device:

initially actuates the coupling device for transferring from the decoupling condition into the coupling condition and the drive motor for exerting an adjustment force on the transmission element, and subsequently actuates the locking device for transfer from the locked condition into the unlocked condition.

* * * * *